US006582111B2

(12) United States Patent
Iwase

(10) Patent No.: US 6,582,111 B2
(45) Date of Patent: Jun. 24, 2003

(54) VEHICLE LAMP

(75) Inventor: Atsushi Iwase, Shizuoka (JP)

(73) Assignee: Koito Manufacturing Co., Ltd., Minato-ku (JP)

( * ) Notice: Subject to any disclaimer, the term of this patent is extended or adjusted under 35 U.S.C. 154(b) by 0 days.

(21) Appl. No.: 09/973,531

(22) Filed: Oct. 9, 2001

(65) Prior Publication Data

US 2002/0122311 A1 Sep. 5, 2002

(30) Foreign Application Priority Data

Oct. 10, 2000 (JP) ..... 2000-308634

(51) Int. Cl.[7] ..... F21V 5/00

(52) U.S. Cl. ..... 362/520; 362/374; 362/375; 362/455; 362/538; 362/509; 362/546; 362/433; 362/487

(58) Field of Search ..... 362/520, 538, 362/509, 546, 308, 311, 326, 327, 433, 186, 189, 487, 459, 374, 375, 455

(56) References Cited

U.S. PATENT DOCUMENTS

| | | | | |
|---|---|---|---|---|
| 6,045,246 A | | 4/2000 | Goto | 362/521 |
| 6,059,433 A | | 5/2000 | Otaka et al. | 362/507 |
| 6,089,736 A | * | 7/2000 | Tanaka | 362/520 |
| 6,318,883 B1 | | 11/2001 | Sugiyama et al. | |

OTHER PUBLICATIONS

WPI Abstract Accession No. 1998–486205 & JP 10208513 (Ichiko Industries) Jul. 8, 1998.

* cited by examiner

*Primary Examiner*—Sandra O'Shea
*Assistant Examiner*—Sharon Payne
(74) *Attorney, Agent, or Firm*—Fish & Richardson P.C.

(57) ABSTRACT

A vehicle lamp structure that enables reliable engagement even when variations occur during molding is described. In a vehicle lamp, an attachment base body 2 may be coupled to a lens 6 covering a front surface thereof by engagement of at least a part. The lens is provided with an engagement leg portion 9 which is inserted into the body so as to be engaged with an engagement portion 10 of the body. First and second engagement protruding portions 11, 12 are formed, with a space therebetween that face the engagement portion of the body. A front surface 11*a* of the first engagement protruding portion is a slanted surface that is increasingly displaced to a side opposite the insertion direction. The engagement portion of the body comprises first and second engagement projections 13, 14 protruding toward the engagement leg portion of the lens, and the engagement leg portion of the lens is engaged with the engagement portion of the body by elastic contact of the slanted surface of the first engagement protruding portion of the lens with the first engagement projection of the body. A front surface of he second engagement protruding portion faces the second engagement projection.

7 Claims, 3 Drawing Sheets

VEHICLE LAMP

BACKGROUND OF THE INVENTION

The present invention relates to a new vehicle lamp structure. In particular, a structure for a vehicle lamp in which an attachment base body such as a body, a reflector, or the like is coupled to a lens covering a front surface thereof by engagement of at least a part, that enables the engagement to be free from looseness by allowing for variations in dimensions generated during molding.

In a vehicle lamp, an attachment base, for example, a body, or a reflector is coupled to a lens covering the front surface thereof by engagement of at least a part.

A conventional vehicle lamp employs a structure such as one as shown in FIG. 4 with regard to portions where the lens is engaged with the body.

Namely, an engagement leg portion b protruding rearward is formed at one end portion of a lens a, and an engagement latch c is provided protruding at a tip portion of the engagement leg portion b. An engagement projection e is formed on an inner side surface of a body d. One end portion of the lens a on which the engagement leg portion b is formed is inserted into the inside portion of the body d, with the other end portion of the lens a engaged with the other end portion of the body d, so that the engagement latch c of the engagement leg portion b is engaged with the engagement projection e of the body d. In this case, a part of the lens a, not shown, abuts against a part of the body d, not shown, thereby restricting an insertion depth of the lens a into the body d.

Typically, the lens a is secured to the body d by both end portions of the lens a being engaged with the body d in the aforementioned manner.

In an aforementioned conventional vehicle lamp, molded positions and dimensions of the engagement leg portion b of the lens a and the engagement latch c thereof, as well as molded positions and dimensions of the engagement projection e of the body d must be designed such that an engagement surface c' of the engagement latch c completely abuts against an engagement surface e' of the engagement projection e, which otherwise may cause looseness.

However if the vehicle lamp is designed in the aforementioned manner, variations during molding may cause looseness, or other problems that may make engagement impossible. Namely, if the engagement surface c' of the engagement latch c is positioned too far to the rear of the design value, a gap is created between the engagement surface c' and the engagement surface e' of the engagement projection e of the body d which may cause looseness. Conversely, if the position of the engagement surface c' is too close to the front (i.e. the length of the leg portion b is too short), during assembly the engagement latch c cannot climb over the engagement projection e to the rear, causing a state where the engagement latch c is unable to engage with the engagement projection e (as shown in FIG. 5).

SUMMARY OF THE INVENTION

The present invention overcomes the problems discussed above to ensure engagement even if variations are generated during molding.

A vehicle lamp according to the present invention is provided to resolve the aforementioned problems. In the vehicle lamp, a lens is provided with an engagement leg portion which is inserted into the attachment base body so as to be engaged with an engagement portion of the attachment base body. Further, first and second engagement protruding portions are formed, with a space therebetween in an insertion direction into the attachment base body, on a surface of the engagement leg portion facing the engagement portion of the attachment base body. A surface of the first engagement protruding portion opposite the insertion direction is a slanted surface that is increasingly displaced to a side opposite the insertion direction, according to departure from the engagement portion of the attachment base body. The engagement portion of the attachment base body comprises first and second engagement projections protruding toward the engagement leg portion of the lens, and the engagement leg portion of the lens is engaged with the engagement portion of the attachment base body by elastic contact of the slanted surface of the first engagement protruding portion and the first engagement projection of the attachment base body. The second engagement protruding portion is positioned on the insertion direction side of the second engagement projection so as to face the second engagement projection.

Accordingly, in a vehicle lamp according to the invention, by the elastic contact of the slanted surface of the first engagement protruding portion of the lens and the first engagement projection of the attachment base body, the lens is urged in the insertion direction, enabling an engagement of the lens with the attachment base body that is free from looseness. In addition, since the second engagement protruding portion of the lens is disposed on the insertion direction side of the second engagement projection so as to face the second engagement projection, the lens can be prevented from falling off of the attachment base body. Nevertheless, since the first engagement protruding portion is engaged with the first engagement projection on the slanted surface of the first engagement protruding portion, the engagement is possible within the range of a length of the slanted surface in the insertion direction, which thereby eliminates the need to accurately design the positional relationship between the second engagement protruding portion and the second engagement projection. This allows variations during molding to be taken into consideration in the design stage, such that there is no looseness or, conversely, engagement problems during assembly due to variations that occurred during molding.

An embodiment of the vehicle lamp according to the present invention will now be described referring to the attached drawings. In the embodiment shown in the drawings, the invention is applied to a vehicle lamp in which the inner lens is attached to the body.

DETAILED DESCRIPTION

Figure 1:
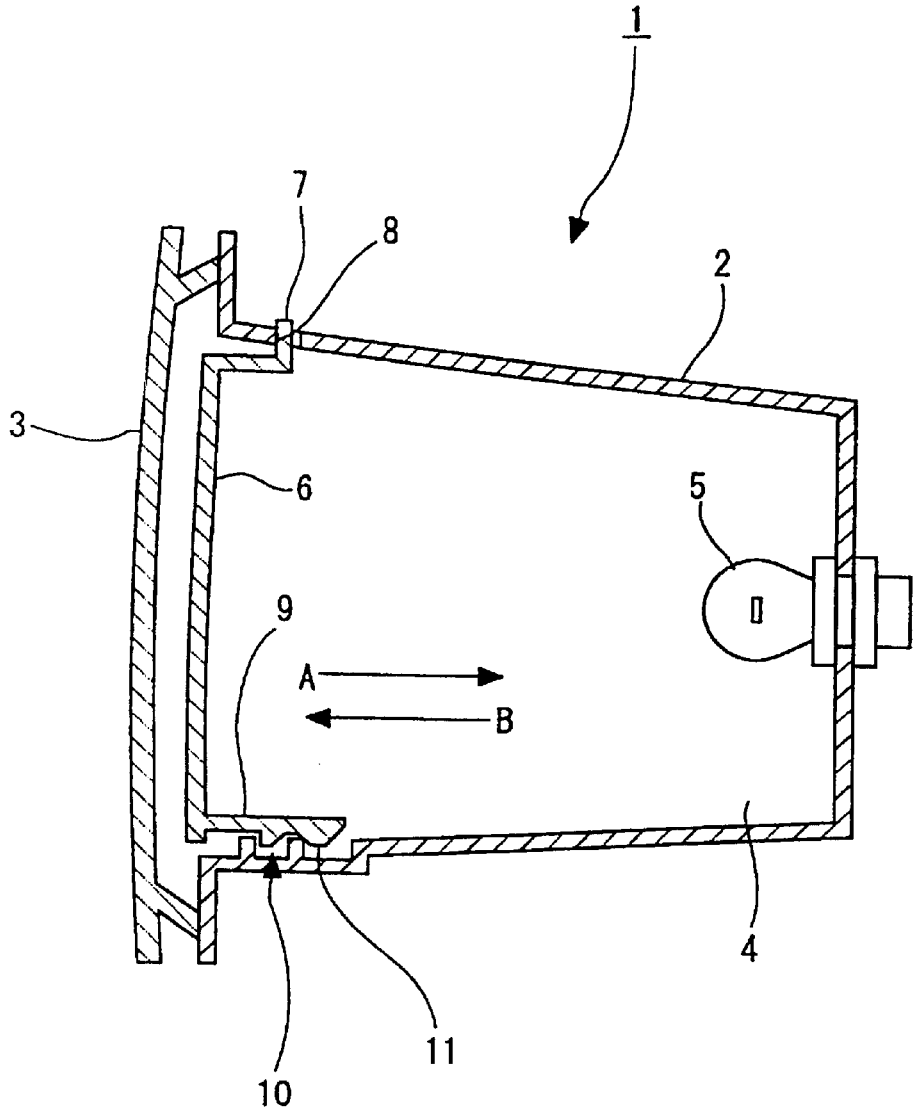
FIG. 1 is a longitudinal sectional view of an embodiment of a vehicle lamp according to the present invention.

FIG. 1 illustrates a vehicle lamp 1 comprising a body 2 with a front surface thereof open, a front cover 3 covering the front surface of the body 2, a light source bulb 5 disposed in a light space 4 defined by the body 2 and the front cover 3, and an inner lens 6 disposed inside of the front cover 3.

The body 2 may be formed by die forming of synthetic resin so as to create a deep recess portion with the front surface open, and a light source bulb may be detachably attached to the rear center of the body 2.

The front cover 3, formed by die forming of glass or transparent synthetic resin, may be attached to the body 2 so as to cover the open surface of the body 2. The front cover 3 is formed as a so-called "plain" cover, without lens steps formed thereon.

The inner lens 6 may be formed by die forming of transparent colorless or transparent colored synthetic resin, and lens steps, not shown, may be formed thereon for controlling light from the light source bulb 5 in a desired manner. The inner lens 6 may be attached to an opening portion of the aforementioned body 2 by engagement means.

At one end portion of the inner lens 6, an engagement piece 7 protruding to the side may be formed and engaged with an engagement hole 8 formed on the side wall near the open surface of the body 2. Further, at the other end portion, namely, the end portion opposite to the end portion at which the engagement piece 7 is formed, an engagement leg portion 9 is formed. The engagement leg portion 9 is engaged with an engagement portion 10 formed on a portion opposite the portion on which the engagement hole 8 is formed, among the side walls of the body 2. The inner lens 6 is thereby attached to the open portion of the body 2.

Figure 2:
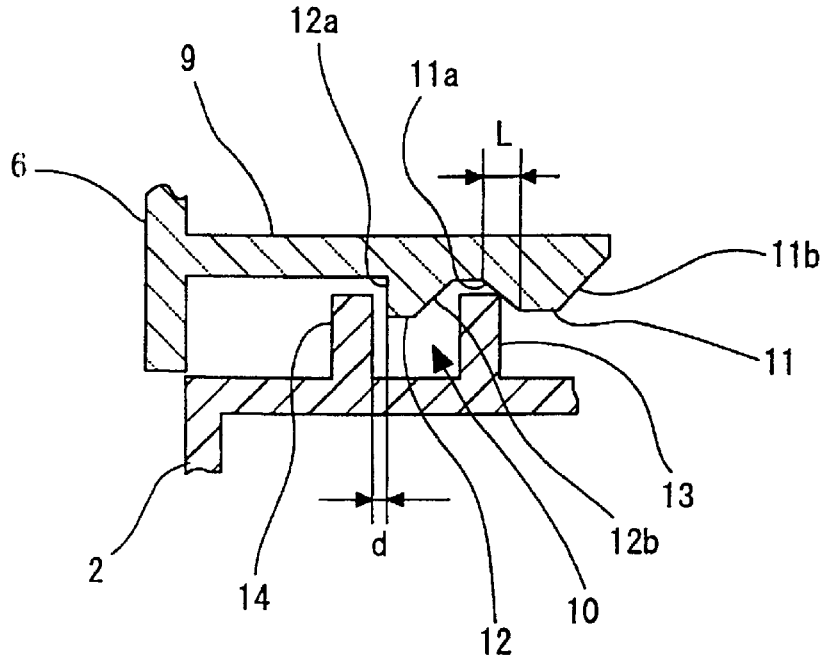
FIG. 2 is an enlarged sectional view of an engagement portion of the vehicle lamp of FIG. 1.

The engagement leg portion 9 protrudes rearward from the end portion of the inner lens 6, toward a deep portion of the body 2 (see Arrow A in FIG. 1). First and second engagement protruding portions 11, 12 are formed with a space therebetween in the longitudinal direction on the surface of the engagement leg portion 9 facing the side wall of the body 2. Referring to FIG. 2, the first engagement protruding portion 11 is formed further to the rear than the second engagement protruding portion 12. Both front and rear surfaces 11*a*, 11*b* of the first engagement protruding portion 11 are slanted surfaces, and the slanted surface at the front is made to be an engagement surface. The slanted surface on the front side (the engagement surface) 11*a* is slanted such that the protruding height becomes smaller in the direction shown by Arrow B in FIG. 1, while the slanted surface at the rear 11*b* is slanted such that the protruding height becomes smaller toward the rear, namely, in the direction shown by Arrow A in FIG. 1. The front surface of the second engagement protruding portion 12 is formed as an engagement surface 12*a* perpendicular to the longitudinal directions (see Arrows A and B of FIG. 1), and the rear surface is a slanted surface 12*b* which is slanted such that the protruding height becomes smaller toward the rear, namely, in the direction shown by Arrow A of FIG. 2.

The engagement portion 10 of the body 2 comprises first and second engagement projections 13, 14 protruding with a space therebetween in the longitudinal direction. The first engagement projection 13 is formed so as to correspond to the first engagement protruding portion 11 of the inner lens 6, and the second engagement projection 14 is formed so as to correspond to the second engagement protruding portion 12 of the inner lens 6. The first engagement projection 13 is formed further to the rear than the second engagement portion 14.

The inner lens 6 is attached to the body 2 as follows.

First, the engagement piece 7 formed on one end portion of the inner lens 6 is engaged with the engagement hole 8 of the body 2. Next, the inner lens 6 is rotated so that the engagement leg portion 9 is inserted into the body 2 so that the engagement leg portion 9 moves in the direction shown by Arrow A in FIG. 1. As a result, the slanted surface 11*b* of the first engagement protruding portion 11 of the engagement leg portion 9 climbs over the second engagement projection 14 and the first engagement projection 13 of the body 2 in sequence. A part, not shown, of the inner lens 6 abuts against a part of the body 2 (not shown), to prohibit further insertion of the engagement leg portion 9 into the body 2. At that time, the engagement surface 11*a* of the first engagement protruding portion 11 engages with the first engagement projection 13 (see FIGS. 1 and 2). Also, during this period, the slanted surface 12*b* of the second engagement protruding portion 12 formed on the engagement leg portion 9 also climbs over the second engagement projection 14, resulting in a state where the engagement surface 12*a* faces the rear surface of the second projection 14 of the body, with some space d therebetween (see FIG. 2). This is a state where the engagement leg portion 9 of the inner lens 6 is engaged with the engagement portion 10 of the body 2.

As aforementioned, when the engagement leg portion 9 of the inner lens 6 is engaged with the engagement portion 10 of the body 2, since the engagement leg portion 9 is deflected according to the departure from the side wall portion of the body, the engagement surface 11*a* of the first engagement protruding portion 11 is in a state where it elastically contacts the first engagement projection 13 of the body 2. As a result, the end portion of the inner lens 6 at which the engagement leg portion 9 is formed is biased in the direction shown in Arrow A. Thus, the surface 11*a* of the inner lens 6 abuts against the first engagement projection 13 of the body reliably, and the inner lens 6 is coupled to he body 2 in a condition substantially free from looseness.

Moreover, the engagement surface 12*a* of the second engagement protruding portion 12 of the inner lens 6 faces the rear surface of the second engagement projection 14 of the body 2. Therefore, even if the engagement of the first protruding portion 11 with the first engagement projection 13 should be released, the engagement surface 12*a* of the second engagement protruding portion 12 would engage with the rear surface of the second engagement projection 14, prohibiting the end portion of the inner lens 6 at which the engagement leg portion 9 is formed from further moving forward, namely, in the direction shown in Arrow B. The inner lens 6 is, therefore, prevented from falling off the body 2. Further, when the engagement leg portion 9 is correctly engaged with the engagement portion 10 (see FIG. 2), it is not necessary for the engagement surface 12*a* of the second engagement protruding portion 12 to contact the second engagement projection 14. This allows the space between both engagement protruding portions to be sufficiently secured, thereby resolving engagement problems such as the second engagement protruding portion 12 climbing over the second engagement projection 14 due to variations that may occur during molding.

In the aforementioned vehicle lamp 1, the first engagement protruding portion 11 of the engagement leg portion 9 is engaged with the first engagement projection 13 of the body 2 at the engagement surface 11*a* which is slanted and has some length L in the longitudinal direction. Therefore, if the engagement protruding portion is designed to be engaged with the first engagement projection 13 at the center with respect to the longitudinal direction of the engagement surface 11*a*, the engagement surface 11*a* can be engaged with the first engagement projection 13 if the dimensions during molding are less than ±L/2. This allows the positional relationship of the second engagement protruding portion 12 and the second engagement projection 14 to be designed taking that into consideration, thereby increasing the degree of freedom in the design stage.

Figure 3:
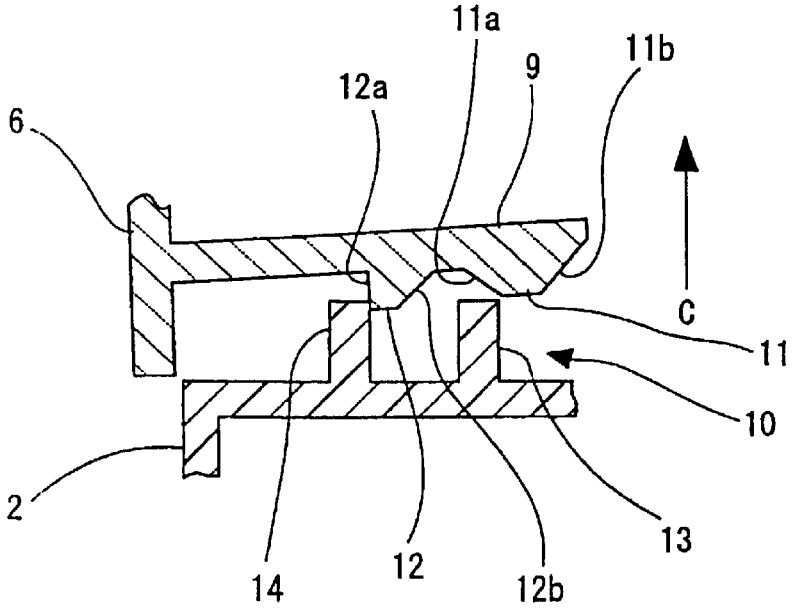
FIG. 3 is an enlarged sectional view showing the operation of the engagement portion of FIG. 2.
Figure 4:
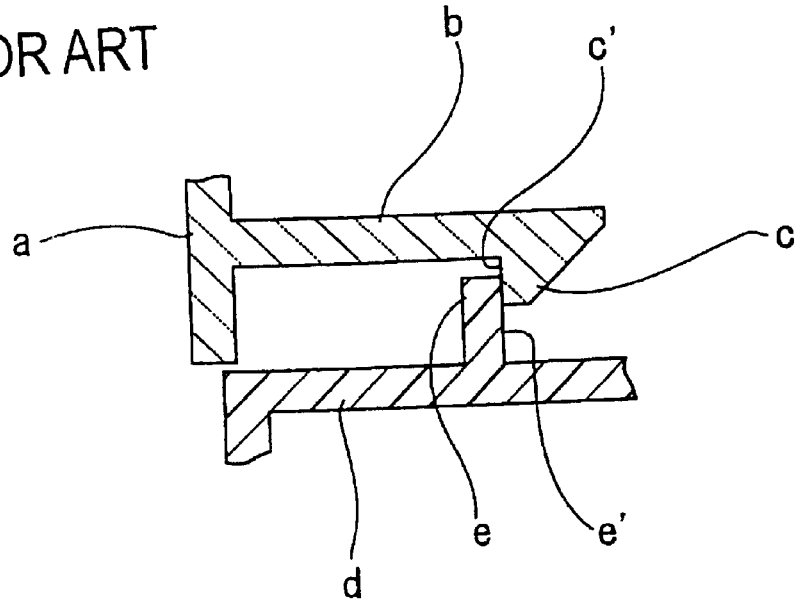
FIG. 4 PRIOR ART
FIG. 4 is an enlarged sectional view showing a portion of a conventional vehicle lamp.
Figure 5:
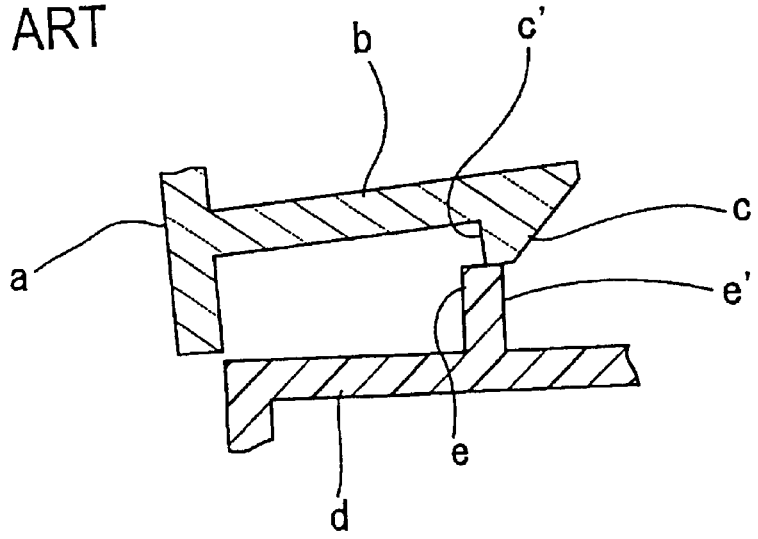
FIG. 5 PRIOR ART
FIG. 5 is an enlarged sectional view showing a problem associated with a conventional vehicle lamp.

Referring to FIG. 3, when engaged with the first engagement projection 13 at a portion closer to the rear end of the engagement surface 11*a* of the first engagement projection portion 11, the deflection of the engagement leg portion 9 becomes larger in the direction in which the tip thereof departs from the side wall of the body 2, namely, in the direction shown by Arrow C. However, the amount of movement in the direction shown by Arrow C caused by the deflection is smaller at a position where the second engagement protruding portion 12 is formed than at a position where the first engagement protruding portion 11 is formed. This prevents the overlap of the second engagement protruding portion 12 and the engagement projection 14 from disappearing. Therefore, even if the engagement of the first engagement protruding portion 11 with the first engagement projection 13 should be released, the second engagement protruding portion 12 can be engaged with the engagement projection 14, preventing the inner lens 6 from completely failing off the body 2 (see FIG. 3).

In the aforementioned embodiment, the present invention is applied in the attachment of an inner lens to the body. However, it is of course understood that the present invention may be applied to attachment of an inner lens to a reflector separately provided from the body, attachment of a lens other than an inner lens to the body, and attachment of a lens to an attachment base body other than a body or a reflector.

Also, the mode or structure for each portion shown in the aforementioned embodiment is merely an example of an implementation of the present invention, and the presentation is not meant to limit the technical scope of the present invention.

As apparent from the above description, in a vehicle lamp according to the present invention, an attachment base body such as a body, a reflector, or the like is coupled to a lens covering a front surface thereof by engagement of at least a part. The lens is provided with an engagement leg portion which is inserted into the body so as to be engaged with an engagement portion of the body. Further, first and second engagement protruding portions are formed, with a space therebetween in an insertion direction into the attachment base body, on a surface of the engagement leg portion facing the engagement portion of the attachment base body. A surface of the first engagement protruding portion opposite the insertion direction is a slanted surface that is increasingly displaced to a side opposite the insertion direction, according to departure from the engagement portion of the attachment base body. Moreover, the engagement portion of the attachment base body comprises first and second engagement projections protruding toward the engagement leg portion of the lens, and the engagement leg portion of the lens is engaged with the engagement portion of the attachment base body by elastic contact of the slanted surface of the first engagement protruding portion of the lens and the first engagement projection of the attachment base body. Further, the second engagement protruding portion is disposed on the insertion direction side of the second engagement projection so as to face the second engagement projection.

Accordingly, in a vehicle lamp according to the present invention, by the elastic contact of the slanted surface of the first engagement protruding portion of the lens and the first engagement projection of the attachment base body, the lens is urged in the insertion direction, enabling engagement of the lens with the attachment base body that is free from looseness. In addition, the second engagement protruding portion of the lens is disposed on the insertion direction side of the second engagement projection so as to face the second engagement projection and prevents the lens from falling off of the attachment base body. The first engagement protruding portion is engaged with the first engagement projection on the slanted surface of the engagement protruding portion so that the engagement is possible within the range of a length of the slanted surface in the insertion direction. Such structure eliminates the necessity of strictly designing the positional relationship between the second engagement protruding portion and the second engagement projection. This allows variations during molding to be taken into consideration in the design stage, therefore there is no looseness or, conversely, engagement problems due to variations during molding.

The second engagement protruding portion of the lens may be positioned with a space on the insertion direction side of the second engagement projection of the attachment base body. Accordingly, by securing a sufficient space between the second engagement protruding portion and the second engagement projection, even if variations are generated during molding, a situation wherein the engagement of the second protruding portion and the second projection is not possible can be avoided.

The first engagement protruding portion is positioned on the side that is inserted first with respect to the second engagement protruding portion. Accordingly, even when the slanted surface of the first engagement protruding portion is engaged with the first engagement projection and thus the engagement leg portion is deflected so that the tip thereof departs from the attachment base body, the amount of movement of the engagement leg portion at a position of the second engagement protruding portion is smaller than at a position of the first engagement protruding portion. Therefore, the risk is reduced of having the engagement between the second engagement protruding portion and the second engagement projection becoming impossible.

What is claimed is:

1. A vehicle lamp in which a base body is coupled to a lens covering a front surface thereof, comprising:

an engagement leg portion provided on the lens for connection to an engagement portion of the base body;

first and second engagement protruding portions having a space therebetween formed on a surface of the engagement leg portion facing the engagement portion of the base body;

wherein the first engagement protruding portion includes a front slanted surface;

first and second engagement projections protruding from the engagement portion of the base body toward the engagement leg portion, wherein the engagement leg portion is engaged with the engagement portion of the base body by elastic contact of the front slanted surface of the first engagement protruding portion and the first engagement projection of the base body, and wherein a front surface of the second engagement protruding portion faces the second engagement projection.

2. The vehicle lamp according to claim 1, wherein the front surface of the second engagement protruding portion of the lens is perpendicular to the insertion direction.

3. The vehicle lamp according to claim 2 wherein when the engagement leg portion is installed, a space is formed between the front surface of the second engagement element and the second engagement projection.

4. The vehicle lamp according to one of claim 1 wherein the first engagement protruding portion is positioned further away from the lens than the second engagement protruding portion.

5. The vehicle lamp according to claim 1 wherein the lens is an inner lens disposed inside a front surface cover that covers the base body.

6. A vehicle lamp structure comprising:

a body having an engagement hole and an engagement portion, wherein the engagement portion includes first and second engagement projections;

a lens having an engagement piece for insertion into the engagement hole and an engagement leg portion for engaging with the engagement portion;

wherein the engagement leg portion includes a first engagement protruding portion with a slanted rear surface and a slanted front surface, and a second engagement protruding portion having a slanted rear surface and a straight front surface perpendicular to a longitudinal direction of the engagement leg, and wherein rear surfaces of the first and second engagement protruding portions displace the engagement leg portion during insertion, and when fully inserted the front surface of the first engagement protruding portion elastically contacts the first engagement projection.

7. The apparatus of claim 6 wherein the engagement piece is formed such that when the lens is inserted, there is a space between the straight front surface of the second engagement element and the second engagement projection.

* * * * *